US006761266B2

(12) United States Patent
Popish

(10) Patent No.: US 6,761,266 B2
(45) Date of Patent: Jul. 13, 2004

(54) PERSONAL BELONGINGS CASE

(76) Inventor: Lavonda L. Popish, 232 Brandonville Rd., Ringtown, PA (US) 17967

( * ) Notice: Subject to any disclaimer, the term of this patent is extended or adjusted under 35 U.S.C. 154(b) by 0 days.

(21) Appl. No.: 10/187,945

(22) Filed: Jul. 3, 2002

(65) Prior Publication Data

US 2004/0004009 A1 Jan. 8, 2004

(51) Int. Cl.[7] ..... B65D 25/04
(52) U.S. Cl. ..... 206/38; 220/524; 220/526
(58) Field of Search ..... 206/38, 534, 538; 220/524, 526, 751; 5/503.1

(56) References Cited

U.S. PATENT DOCUMENTS 687,664 A * 11/1901 Smith ..... 220/508
1,661,728 A 3/1928 La Rue
1,686,002 A * 10/1928 Herzon ..... 206/5
3,614,136 A * 10/1971 Dent ..... 280/500
4,418,823 A * 12/1983 Romick ..... 206/538
4,793,492 A 12/1988 Halbich
4,831,673 A * 5/1989 Winckler ..... 5/503.1
4,915,251 A 4/1990 Payne
5,323,926 A 6/1994 Pomroy et al.
5,358,100 A 10/1994 Wolff
2001/0035416 A1 * 11/2001 Dodson ..... 220/524

* cited by examiner

*Primary Examiner*—David T. Fidei
(74) *Attorney, Agent, or Firm*—Richard C. Litman

(57) ABSTRACT

A durable plastic case having three compartments for storing eyeglasses, hearing aids, and dentures, respectively, of a particular person. The lid of each compartment has the name of the item for which that compartment is intended imprinted thereon in text and Braille. Each compartment opens independently. An L-shaped overhang or pair of hooks is positioned on the back of the case for suspending on the bedstead of the person for whom the items are stored. The lids have hinges such that the left lid opens outwardly to the left, the center lid opens to the rear, and the right lid opens outwardly to the right.

17 Claims, 7 Drawing Sheets

PERSONAL BELONGINGS CASE

BACKGROUND OF THE INVENTION

1. Field of the Invention

The present invention relates to compartmented containers. More particularly, the present invention relates to compartmented containers providing access to separately stored items by lifting one or more lids.

2. Description of the Related Art

The convenient storage of personal items in a hospital setting, and particularly in a nursing home presents a serious problem. This is particularly true in the case of the elderly, who tend to require articles such as eyeglasses, dentures, and hearing aids readily available at bedside. It would be desirable to provide a compartmented case which attaches to the bedstead or nearby surface which separately and sanitarily holds such items. It would also be desirable if each compartment had a separate lid marked such that the item inside may be identified by sight or feel.

U.S. Pat. No. 1,661,728, issued Mar. 6, 1928, describes a box with separate and distinctive compartments. The box is made of sheet metal having, preferably, a square or rectangular opening.

U.S. Pat. No. 5,358,100, issued Jan. 8, 1993, to Wolff, describes a cosmetic and jewelry organizer for holding and storing items in an organized fashion. The organizer includes a base portion and cover portion. Tray assemblies are connected to the base portion by link arms for movement from a position within the base portion to a position over the side wall of the base portion. Each tray assembly includes a tray having a plurality of compartments and pivotal holders which are specially configured to hold specific items.

U.S. Pat. No. 4,793,492, issued Dec. 27, 1985, to Halbich, describes a home care pillbox having a plurality of compartments. Each compartment has an individual lid marked with a letter for a day of the week. Each lid may also be marked in Braille.

U.S. Pat. No. 5,323,926, issued Jun. 28, 1994, to Pomeroy et al., describes a compartmented lunch box with compartments closed by a flat lid.

U.S. Pat. No. 4,915,251, issued Apr. 10, 1990, to Payne, describes a plastic container having a plurality of compartments and a snap lock closure.

None of the above inventions and patents, taken either singularly or in combination, is seen to describe the instant invention as claimed. Thus a personal belongings case solving the aforementioned problems is desired.

SUMMARY OF THE INVENTION

The present invention is a durable plastic case having three compartments for storing eyeglasses, hearing aids, and dentures, respectively, of a particular person. The lid of each compartment has the name of the item for which that compartment is intended imprinted thereon in text and Braille. Each compartment opens independently. An L-shaped overhang or spaced pair of hooks are positioned on the back of the case for suspending on the bedstead of the person for whom the items are stored.

Accordingly, it is a principal object of the invention to provide a compartmented case for personal articles.

It is another object of the invention to provide a compartmented case as above specifically sized for an individual's eyeglasses, hearing aids, and dentures.

It is yet a further object of the invention to provide a compartmented case as above which may be easily attached to a bedstead or a nearby surface such that the user may easily reach the items without exiting the bed.

It is still a further object of the invention to provide a compartmented case as above in which each compartment has an individual lid marked for sight or feel identification of the item stored inside.

Still another object of the invention is to provide a compartmented case as above which is easily cleaned for reuse such as in an institutional environment.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a durable plastic case having three compartments for storing eyeglasses, hearing aids, and dentures, respectively, of a particular person. The lid of each compartment has the name of the item for which that compartment is intended imprinted thereon in text and Braille. Each compartment opens independently. An inverted L-shaped overhang or spaced pair of hooks are positioned on the back of the case for suspending on the bedstead of the person for whom the items are stored.

Figure 1:
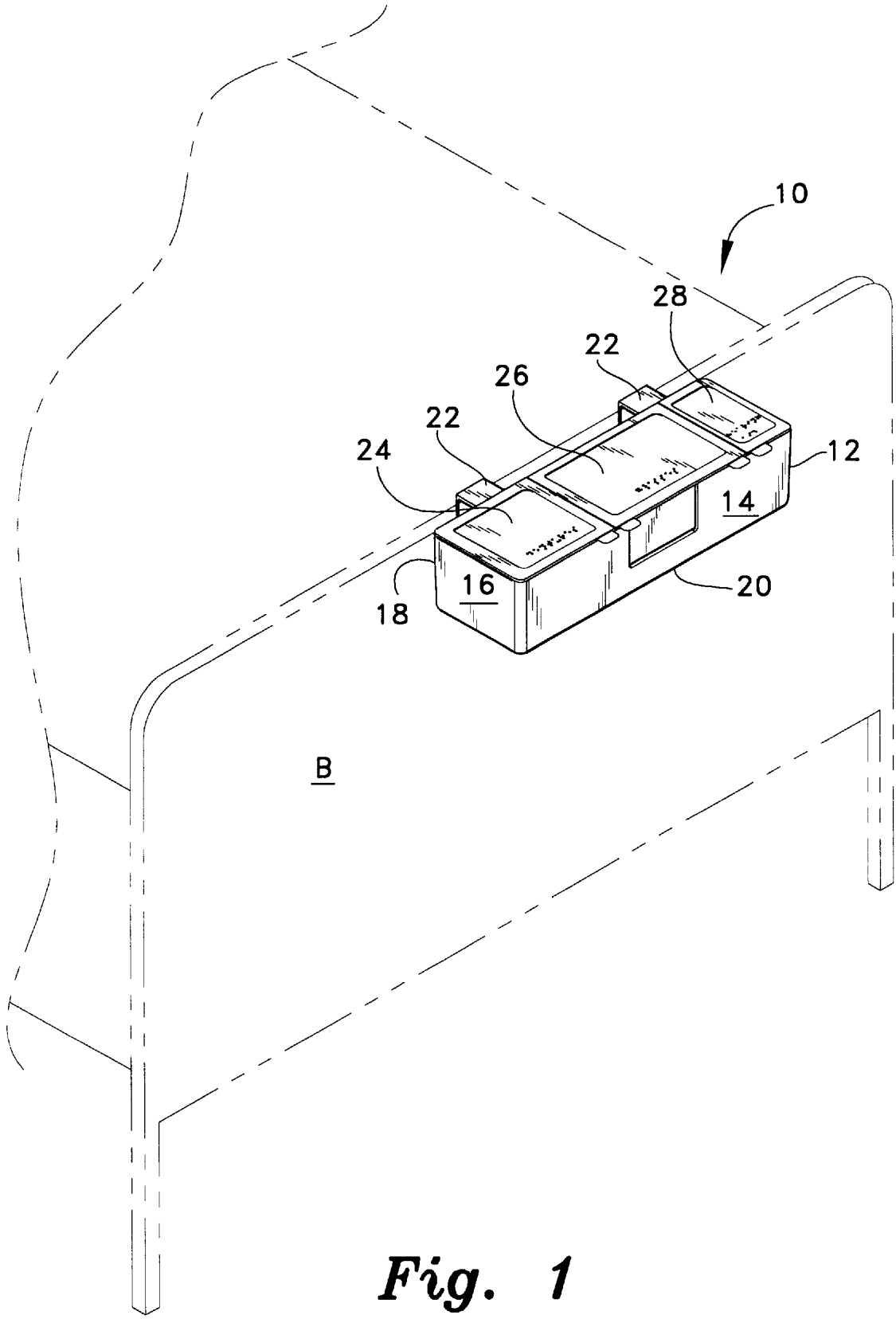
FIG. 1 is an environmental, perspective view of the personal belongings case according to the present invention.

Referring to FIG. 1, there is shown an environmental perspective view of the personal belongings case of the present invention, designated 10. Personal belongings case 10 includes an integral body 12 having a front wall 14, left and right sidewalls 16, a rear wall 18 and a bottom wall 20, which is divided by spaced internal walls parallel to side walls 16 to form separate compartments therein, the integral body 12 and side walls 26 forming a common upper edge. Each compartment is tailored in length so as to conform with specific objects to be stored therein. In the preferred embodiment, three compartments are provided to hold the dentures, eyeglasses, and hearing aids of an individual. The case 10 has integral hooks 22 extending rearwardly from the upper edge of rear wall 18, providing for the hanging of the box over an object of furniture such as the individual's bedstead B. This configuration is particularly useful for elderly institutionalized persons where an individual's private storage space is at a premium. As shown in FIG. 1, a preferred embodiment has a first leftward compartment covered by denture compartment lid 24, a second central compartment covered by eyeglasses lid 26, and a third rightward compartment covered by hearing aid lid 28.

Figure 2:
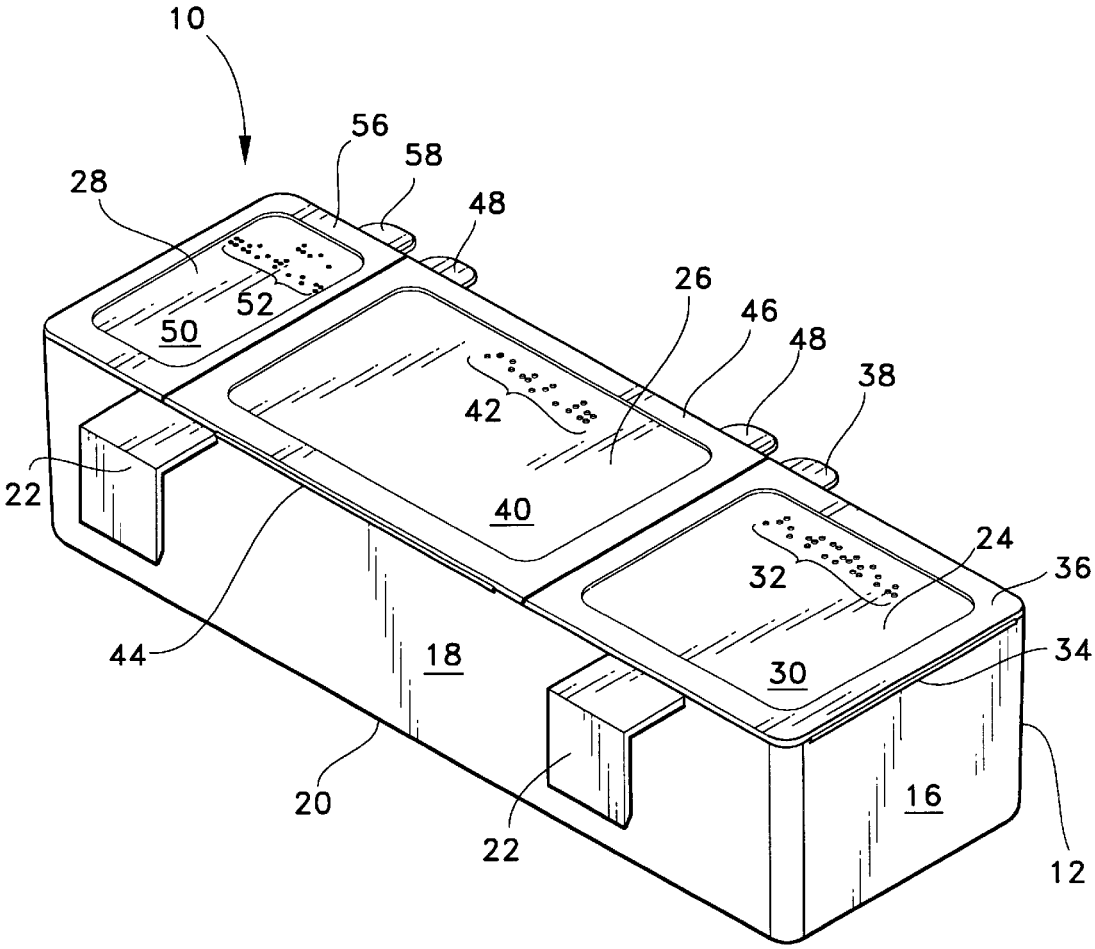
FIG. 2 is a rear perspective view of the belongings case of FIG. 1.
Figure 3:
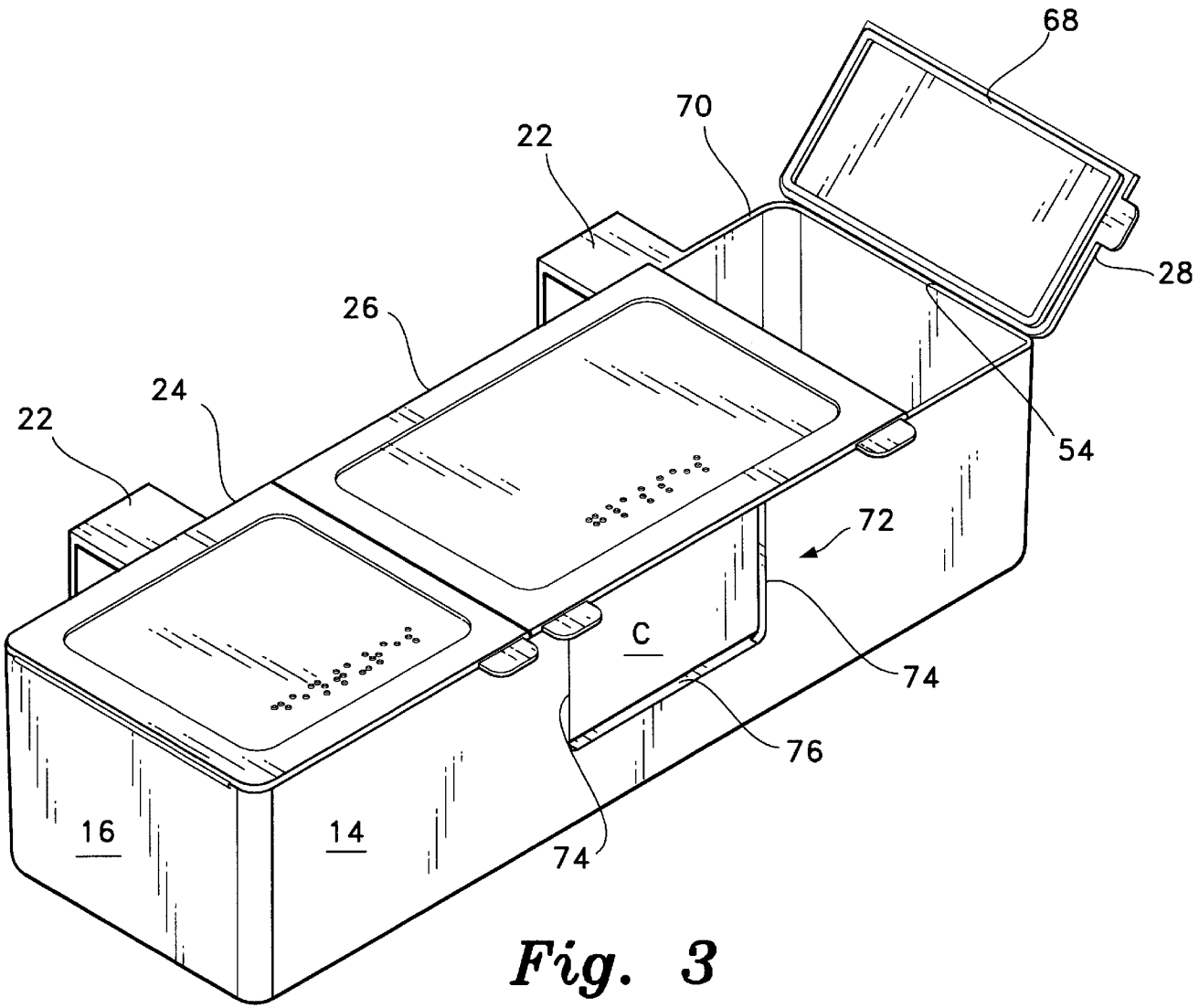
FIG. 3 is a side perspective view of the belongings case of FIG. 1 with one lid open.

Referring to FIGS. 2 and 3, there are shown a rear perspective view of the invention and a side perspective view thereof with a lid in the open position, respectively. As seen in FIG. 2, denture compartment lid 24 has an outer rim 36 extending from a recessed flat portion 30. The recessed flat portion 30 has indicia such as Braille message 32 thereon, preferably identifying the contents as "DENTURES." The eyeglasses compartment lid 26 has an outer rim 46 extending from a recessed flat portion 40. The recessed flat portion 40 has a Braille message 42 thereon, preferably identifying the contents as "GLASSES." The hearing aid compartment lid 28 has an outer rim 56 extending from recessed flat portion 50. The recessed flat portion 50 has a Braille message 52 thereon, preferably identifying the contents as "HEARING AID." If the lids 24, 26, and 28 are molded plastic, the molds may include the Braille messages.

As further shown in FIGS. 2 and 3, denture lid 24 is attached at the upper edge of side wall 16 by hinge 34, which may be configured as an integral living hinge, opening to the side by pulling upward on tab 36. Eyeglasses lid 26 is attached at the upper edge of rear wall 18 by hinge 44, which may be configured as an integral living hinge, opening to the rear by pulling upward on tabs 48. Hearing aid lid 28 is attached at the upper edge of opposing side wall 16 by hinge 58, which may be configured as an integral living hinge, opening to the opposing side by pulling upward on tab 58.

As shown in FIG. 3, hearing aid lid 28 (see FIG. 2) is shown in an open position as held by hearing aid lid hinge 54 and has a circumferential ridge 68 depending from flat portion 50 so as to securely fit within the upper edge of the hearing aid compartment. Also, identification card C is held in front wall 14 by card receiver outer wall 74 and supported by card receiver support wall 76.

Figure 4A:
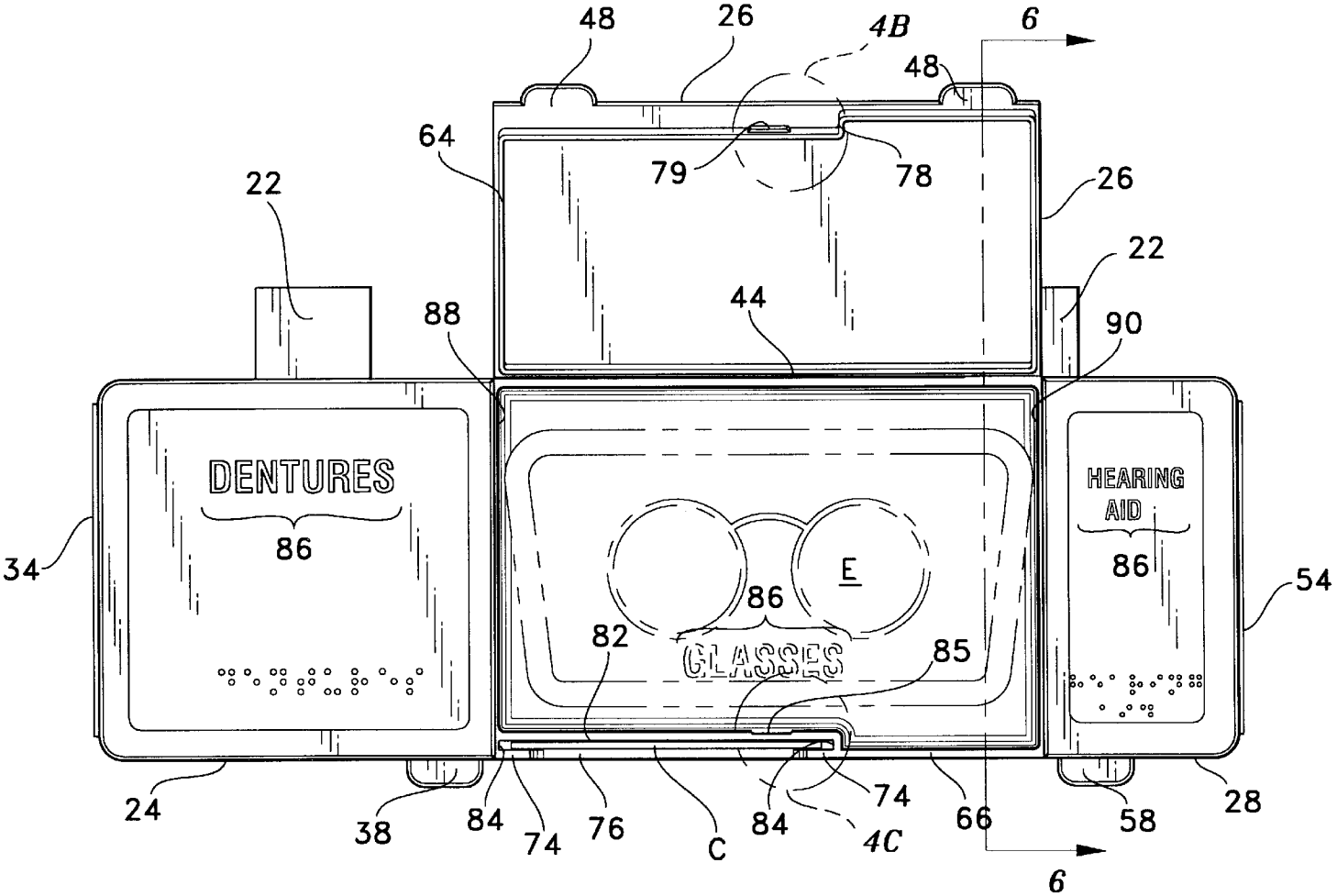
FIG. 4A is a plan view of the case of FIG. 1 with one lid open.
Figure 4B:
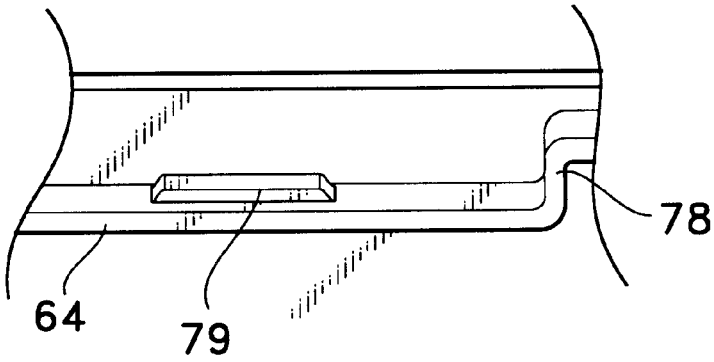
FIG. 4B is a detail view of the closure snap of FIG. 4A.
Figure 4C:
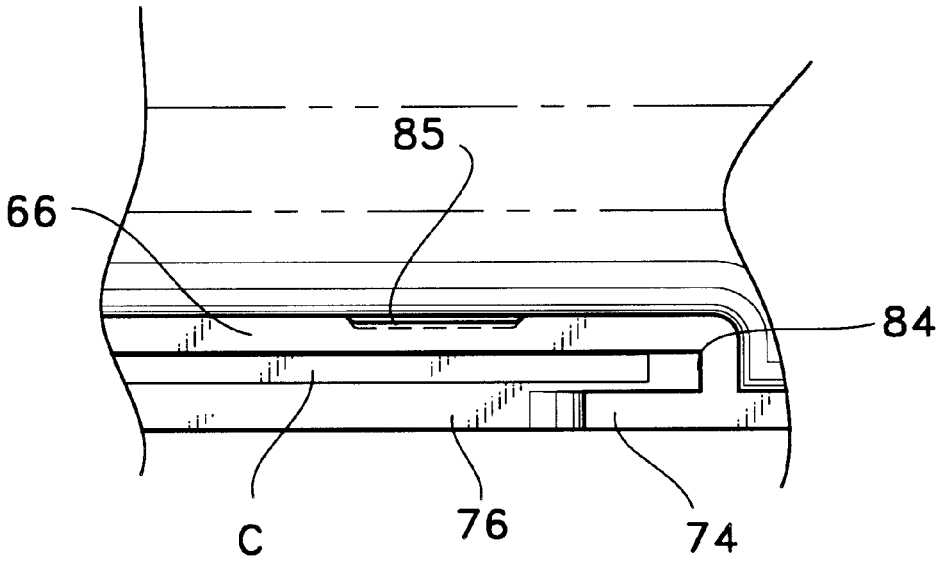
FIG. 4C is a detail view of the closure snap receiver portion of FIG. 4A.

Referring to FIGS. 4A, 4B, and 4C, there are shown a plan view of the inventive personal belongings case with the eyeglasses compartment lid open, illustrating a pair of eyeglasses E stored within, and detail views of the closure snap and the closure snap receiver, respectively. As is illustrated, lettering 86 may also be imprinted or molded into the lids 24, 26(lettering shown on phantom closed lid), and 28 designating their contents, i.e., "DENTURES," "GLASSES," and "HEARING AID." As is shown, in FIGS. 4A and 4B, lid depending ridge 64 has an inner offset adjacent closure snap 79, spacing closure snap 79 inward along the flat portion 40 of eyeglasses lid 26. Lid ridge 64 fits inside the eyeglasses portion of upper edge 66 of the integral body 12 formed by rear wall 18, front wall 14, and sidewalls 16 and dentures-eyeglasses compartments separating wall 88, and eyeglasses-hearing aid compartments separating wall 90(the upper edge 66 of each being shown partially covered by lid 24 and lid 26).

As seen in FIG. 4A and detail 4C, the front portion of the eyeglasses compartment includes a lower identification card receiving support 76, identification card receiver outer walls 74, and a lower identification card receiving support 76, forming identification card side slots 84 with identification card receiver inner wall 82. Upper edge 66 is offset inwardly and extends along wall 82, forming a closure snap receiver 85 such that when lid 26 is closed over the eyeglasses compartment, lid ridge 64 fits snugly within upper edge 66 and closure snap 79 snaps into closure snap receiver 85, thus locking lid 26 in a closed position. The flat surfaces extending between the periphery of lids 24, 26, and 28 and their respective depending ridges fit against common upper edge 66 of case integral body 12.

Figure 5:
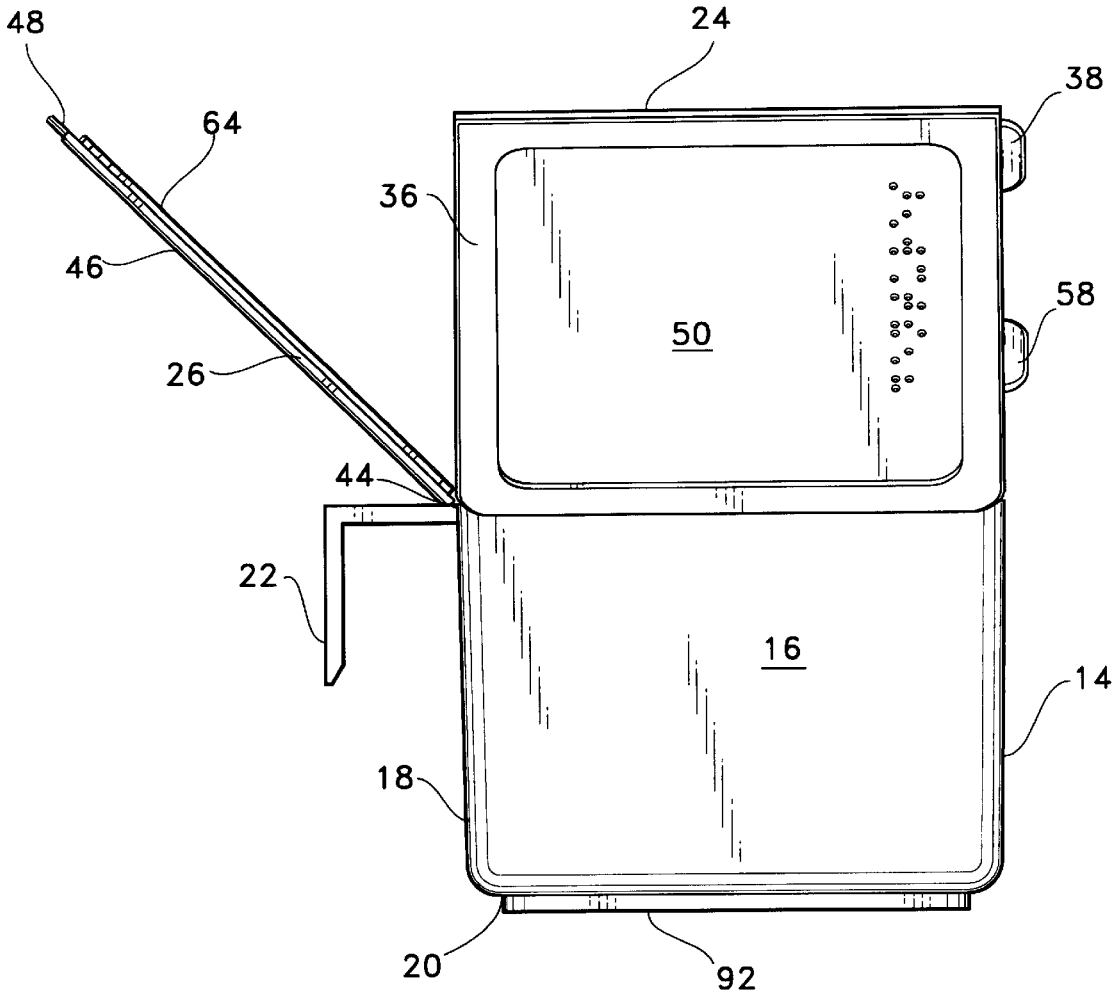
FIG. 5 is a side elevation view of the belongings case of FIG. 1, with all lids open.

Referring to FIG. 5, there is shown a side elevation view of the inventive case with all lids open having front wall 14, rear wall 18, left side wall 16, bottom wall 20, hooks 22, and denture compartment lid 28 having denture lid border 36 and pull tab 38. Also seen is hearing aid lid pull tab 58, as well as eyeglasses compartment lid 26 on hinge 44 having lid border 46 and pull tabs 48. Bottom wall compartment rims 92 extend below bottom 20 and fit within denture lid border 36, eyeglasses lid border 46, and hearing aid border 56 of an identical case, thus making the inventive case stackable.

Figure 6:
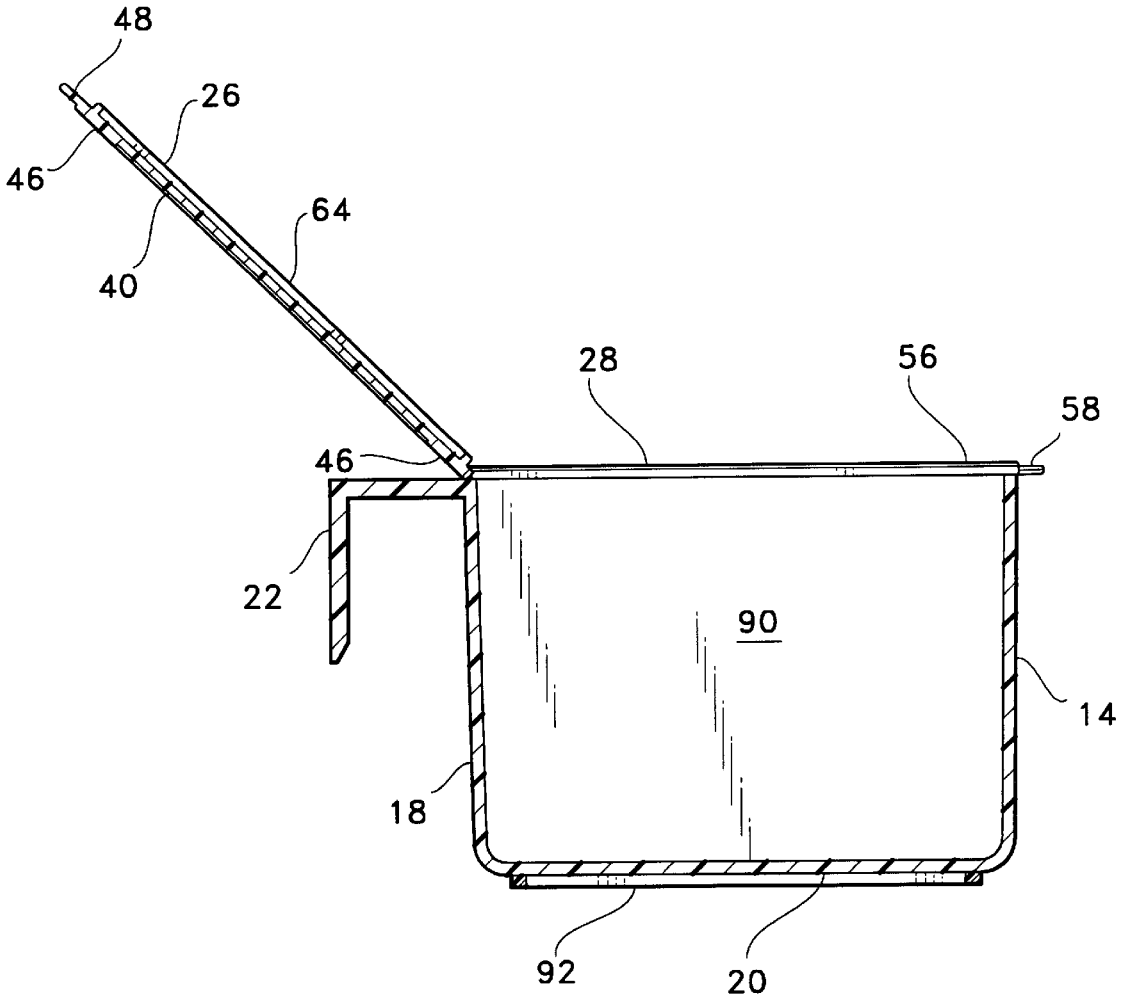
FIG. 6 is a sectional view taken along the lines 6—6 of FIG. 4.

This is further shown in FIG. 6, where there is shown a sectional view of the inventive case as shown in FIG. 4A, wherein rim 92 is shown extending down from case bottom 20. Also shown in FIG. 6 is separating wall 90 integral with and extending between front wall 14, rear wall 18, and bottom wall 20. Hook 22 is integral with and extends from the upper portion of rear wall 18. Eyeglasses compartment lid 26 is shown having flat portion 40 and surrounded with border 46 and lid ridge 64, pull tab 48 extending outward from lid 26. Hearing aid lid 28 as shown includes border 56 and pull tab 58.

The inventive case is preferably molded plastic, but may be made of any appropriate material such as metal. The various edges corners within the inventive case structure may be radiused or rounded as desired to expedited molding of the case and ease cleaning. The inventive case may include any number of desired compartments of differing sizes. It is to be understood that the present invention is not limited to the embodiment described above, but encompasses any and all embodiments within the scope of the following claims.

I claim:

1. A personal belongings case comprising:

a case body having a front wall, a rear wall, side walls, at least one interior wall parallel with said side walls and spaced therefrom so as to define a plurality of compartments, and a bottom wall, each of said compartments of such size as to receive a personal item;

a hook portion extending outward and downward from an upper portion of said rear wall; and a plurality of removable lids for removably covering each of said compartments;

said case body and said at least one interior wall having a common upper edge for adjacent compartments; and each said removable lid having a recessed flat portion defined by a surrounding frame on an upper side and having a depending ridge spaced from the periphery thereof which fits snugly within said common upper edge of each of said compartments.

2. The case of claim 1, wherein said at least one interior wall is two interior walls.

3. The case of claim 2, wherein said interior walls are so spaced as to define a first compartment of a size suitable to house a person's dentures, a second compartment of a size suitable to house a person's eyeglasses, and a third compartment of a size suitable to house a person's hearing aid.

4. The case of claim 3, wherein said first compartment is located on a first side of said case body, said second compartment is centrally located, and said third compartment is located on an opposite second side of said case body.

5. The case of claim 4, wherein said second compartment is of such length as to receive eyeglasses in a closed, lengthwise position.

6. The case of claim 1, wherein each of said removable lids is attached with a corresponding portion of said common upper edge by a hinge so as to provide for opening and closing over each of said compartments.

7. The case of claim 2, wherein each said removable lid has identifying indicia located thereon identifying the item enclosed within its corresponding compartment.

8. The case of claim 7, wherein said indicia includes Braille markers.

9. The case of claim 7 wherein said indicia includes raised lettering.

10. The case of claim 6 wherein said hinge for said lid corresponding to said first compartment is located along one of said side walls of said case body, said hinge for said lid corresponding to said second compartment is located along the rear wall of said case body, and said hinge for said lid corresponding to said third compartment is located along the other of said side walls of said case body.

11. The case of claim 10, wherein said hinges for said lids for said first compartment, said second compartment, and said third compartment are integral therewith and integral with corresponding portions of said common upper edge.

12. The case of claim 3, wherein the portion of said front wall corresponding with said second compartment includes structure for receiving an identification card parallel therewith.

13. The case of claim 12, wherein said card receiving structure comprises a lower card support wall spaced upward from said bottom wall, a card support inner wall spaced inward from said front wall, and spaced identification card receiver outer walls integral with said front wall forming side slots with said inner wall so as to receive the lateral edges of an identification card.

14. The case of claim 13, wherein said card support inner wall shares said common upper edge of said case body and includes a centrally located closure snap receiver at its upper edge, and said depending ridge of said lid corresponding with said second compartment has an inner offset therealong so as to fit within said upper edge of said second compartment having said inward spaced card support inner wall and said depending ridge has an outwardly facing closure snap integral therewith so positioned as to engage said closure snap receiver.

15. The case of claim 10, each said lid comprising at least one pull tab extending outward along said front wall of said case body, each said pull tab being located at a point remote from said corresponding hinge.

16. The case of claim 15, said lid corresponding to said second compartment having two pull tabs spaced apart and extending outward along said front wall.

17. A personal belongings case, particularly for an institutionalized elderly persons comprising:

an upward opening integral case body having a common upper edge and having a front wall, a rear wall, a left sidewall, a right sidewall, a bottom wall and first and second spaced intermediate walls parallel with said left and right sidewalls defining a first, a second, and a third compartment;

said common upper edge and said bottom wall of said case body being of such depth as to fully receive horizontally disposed dentures, a pair of glasses horizontally disposed lengthwise, and a hearing aid in corresponding first, second, and third compartments;

said case body having two hooks spaced along said rear wall and extending horizontally rearward from points along said upper edge, said hooks extending downward at a point spaced from said rear wall so as to engage and secure said case body at a horizontal position with a bedstead or similar furnishings;

said first intermediate wall being so positioned as to form said first compartment having a horizontal length adequate to receive and store the person's dentures in a horizontal position;

said second intermediate wall being so positioned relative to said first intermediate wall as to form said second compartment having a horizontal length adequate to receive and store the person's eyeglasses in a horizontal, lengthwise position;

said right sidewall being so positioned relative to said second intermediate wall as to form said third compartment having a horizontal length adequate to receive and store the person's hearing aid;

said case body having a first, a second, and a third removable lid for individually opening and closing corresponding said first, said second, and said third compartments and conforming therewith;

said first lid having a hinge attached along said upper edge of said left sidewall;

said second lid having a hinge attached along said upper edge of said rear wall; and said third lid having a hinge attached along said upper edge of said right sidewall;

each said first, said second and said third lid having indicia thereon for identifying the item of personal belongings contained in said corresponding first, second and third compartments.

* * * * *